United States Patent [19]

Erber et al.

[11] Patent Number: 5,003,778

[45] Date of Patent: Apr. 2, 1991

[54] STIRLING ENGINE

[75] Inventors: Anton Erber, Mühlhausen; Heinz Hoff, Königsbrunn; Günter Reuchlein, Augsburg; Hanno Schaaf, Friedberg; Gerhard Schiessl, Augsburg, all of Fed. Rep. of Germany

[73] Assignee: Man Technologie Aktiengesellschaft, Munich, Fed. Rep. of Germany

[21] Appl. No.: 490,739

[22] Filed: Mar. 8, 1990

Related U.S. Application Data

[62] Division of Ser. No. 269,639, Nov. 10, 1988, Pat. No. 4,953,354.

[30] Foreign Application Priority Data

Nov. 25, 1987 [DE] Fed. Rep. of Germany ..... 3709926
Feb. 26, 1988 [DE] Fed. Rep. of Germany ..... 3806114

[51] Int. Cl.[5] ..... F02G 1/055

[52] U.S. Cl. ..... 60/517; 431/161; 431/247

[58] Field of Search ..... 60/517; 431/161, 167, 431/247, 350

[56] References Cited

U.S. PATENT DOCUMENTS

| | | | |
|---|---|---|---|
| 3,516,807 | 6/1970 | West et al. | 431/350 X |
| 4,573,320 | 3/1986 | Kralick | 60/517 |
| 4,850,857 | 7/1989 | Obermuller | 431/247 X |

*Primary Examiner*—Allen M. Ostrager
*Attorney, Agent, or Firm*—Frishauf, Holtz, Goodman & Woodward

[57] ABSTRACT

A thermally insulating lining for the housing of the heater system ensures that on the outside of the heater system only low temperatures are reached which are not dangerous to operators in the vicinity of the engine. Combustion air duct means between an air preheater and a burner is formed by a large number of tubes arranged alongside each other in at least one row and along an inside wall of the combustion chamber. These tubes ensure that the flow state remains satisfactory and constant and they are substantially more durable than sheet metal duct means as used hitherto.

20 Claims, 4 Drawing Sheets

1/6

1/7
2
14
10
20
11
13
12
8
9
21
19
3
7
5
6
4
6/1
3/1
3/2

STIRLING ENGINE

This is a division of application Ser. No. 07/269,639, filed Nov. 10, 1988, Erber, now U.S. Pat. No. 4,953,354, Sept. 4, 1990.

FIELD OF THE INVENTION

The invention relates to a Stirling engine with a heater system whose housing, defined by an external wall provided with a termally insulating lining, is fitted with a device for so ducting the combustion air that it can be preheated.

BACKGROUND

Various designs for conducting the combustion air in Stirling engines have been proposed. Known Stirling engines (see for instance the U.S. Pat. No. 3,811,272, the British Patent No. 1,394,033, the British patent application No. 15386/86 and the Swedish application No. 7301058-9) were so designed that the combustion air was fed via a single continuous duct between the air preheater and the burner. Such ducts were made of straight sheet metal pipes with flat walls or, in the case of small engines with only a single burner and a round arrangement of the heater pipes and the air preheater, by concentrically arranged conical sheet metal shrouds. In the case of Stirling engines with heater spaces having a large size and more especially in the case of engines with a number of serially arranged heater spaces, the high thermal load tends to bulging and kinking or creasing of such flat or slightly dished walls of the ducts for the combustion air. This in turn leads to poor aerodynamics at the surface of the sheet metal, this leading to a reduced cooling of the heat exchange surfaces by the combustion air to be preheated, and ultimately to overheating or even fusing of the sheet metal walling.

In the case of high air flow rates such sheet metal ducts have to be stiffened by ribs, which greatly increases the price of the duct system.

THE INVENTION

It is an object of the invention to create a combustion air ducting means for a Stirling engine which is simple and dimensionally stable, while providing for constant and satisfactory flow conditions, and which is sufficiently cooled by the combustion air flowing therethrough.

Briefly, in accordance with a feature of the invention, a Stirling engine with a heater system has an arrangement for ducting the combustion air, which is placed in the housing of the system. The housing is defined by an outer wall provided with a thermally insulating lining. The ducting arrangement extends between at least one air preheater through which air and, for the purpose of preheating the air, burnt gas from at least one burner flows. The arrangement includes a large number of tubes placed between the air preheater and a burner, the tubes forming at least one row arranged alongside each other and to a wall of the housing.

Such tubes are comparatively cheap and furthermore are readily connected with the air preheater and the burner and owing to their dimensional stability guarantee satisfactory and constant flow characteristics between the air preheater and the burner and sufficient internal cooling.

DRAWINGS

DETAILED DESCRIPTION

Figure 1:
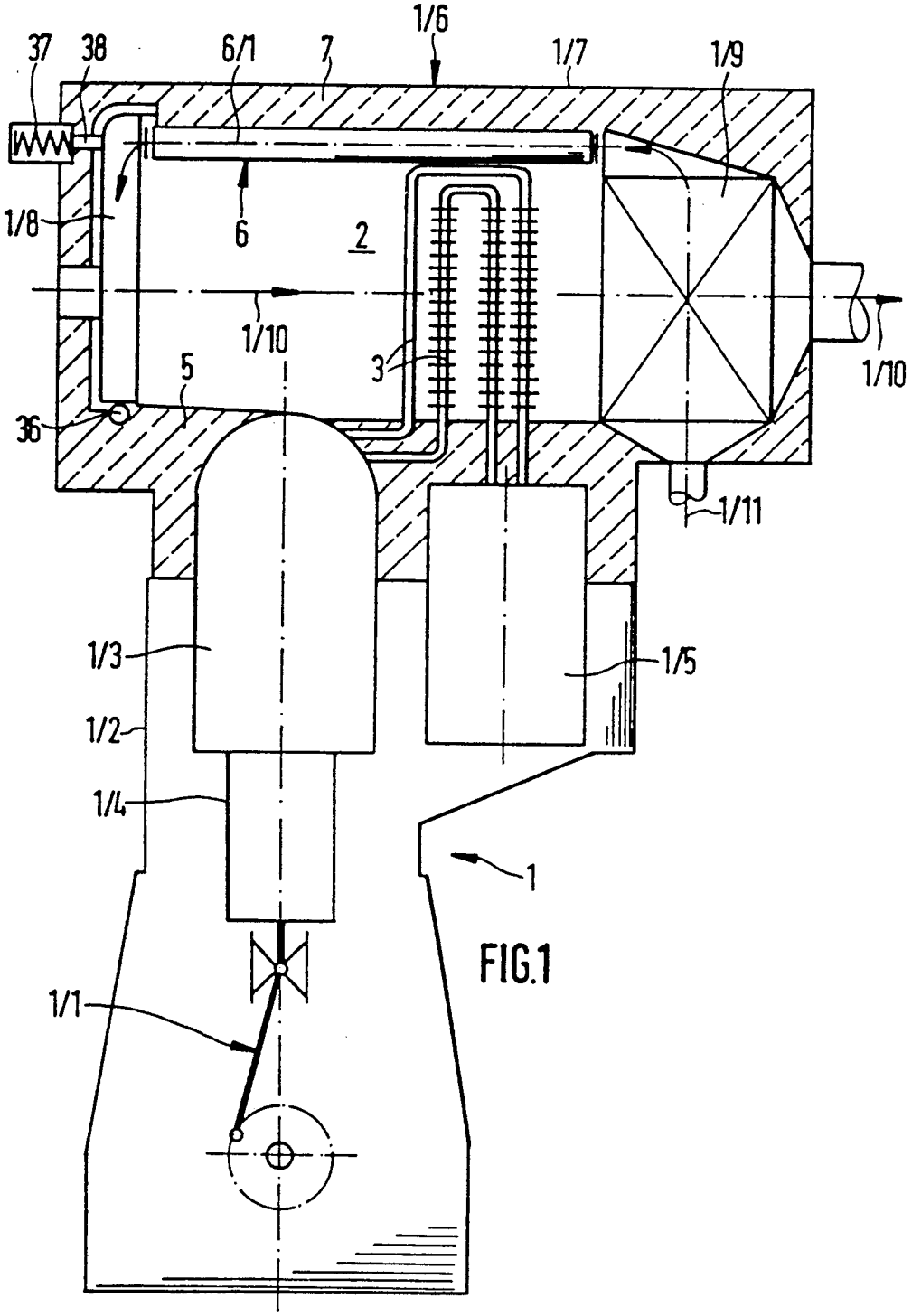
FIG. 1 is a cross section taken through a Stirling engine with cylinders arranged in line.

In the figures like parts are denoted by like reference numerals. In the Stirling engines 1 shown diagrammatically in FIGS. 1 through 3, the power unit 1/1, the engine housing 1/2, the cylinders 1/3 with pistons therein, the piston rod seals 1/4, the regenerator and cooling units 1/5 and the duct means for the working gas are of conventional design. The present invention is primarily concerned with the heater system 1/6, which in effect constitutes the head of the engine 1.

The heater system 1/6 has a housing with an outer wall 1/7, which is internally thermally insulated by a lining. Furthermore, the heater system 1/6 comprises at least one burner 1/8 for the production of burnt gas and at least one air preheater 1/9 formed for instance by a single stage or multistage intersecting plate heat exchanger 6 (FIG. 4) for guiding the flow of combustion air. The air preheater 1/9 has both the burnt gases produced by the burner 1/8 (moving in the direction marked by the arrow 1/10) and also the air (in the direction 1/11) coming from a blower (not shown) flowing through it. The latter air is thus heated.

The burner 1/8 is in the form of a selfcontained assembly conventional for Stirling engines 1 and comprises an air swirling device, an injection device, an ignition device, a combustion chamber, a recirculating device and the like.

The burner 1/8 supplied with air and fuel, as for instance oil or gas, produces burnt gas at a temperature in the order of 2000° C., which in the heater space 2 of limited size produces heat which is initially transferred to heater tubes 3 for heating the working gas (for instance helium) flowing therethrough, to the working temperature. Such burnt gas then also gives up heat in the air preheater 1/9 before being finally led off from the heater system 1/6 by means of an exhaust gas pipe.

Figure 2:
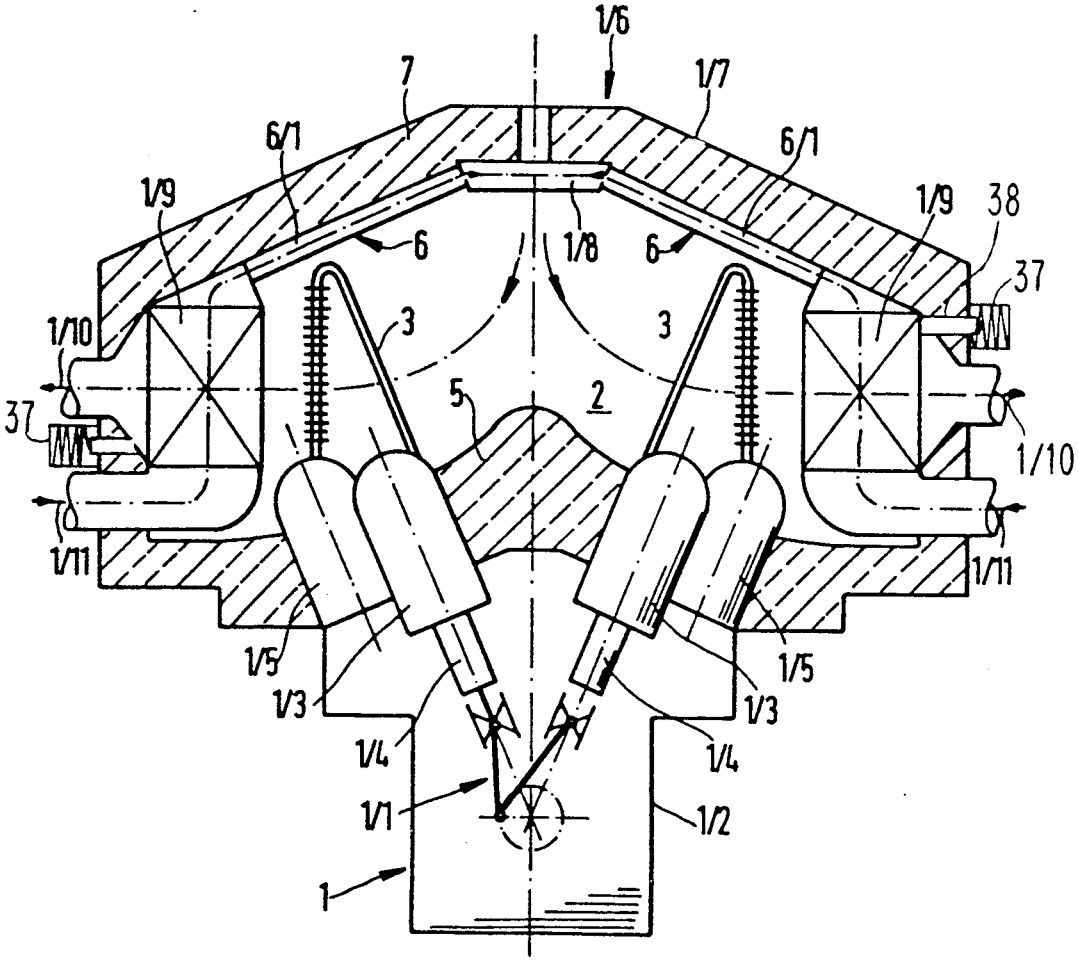
FIG. 2 is a cross section taken through a Stirling engine with a V-engine configuration.
Figure 3:
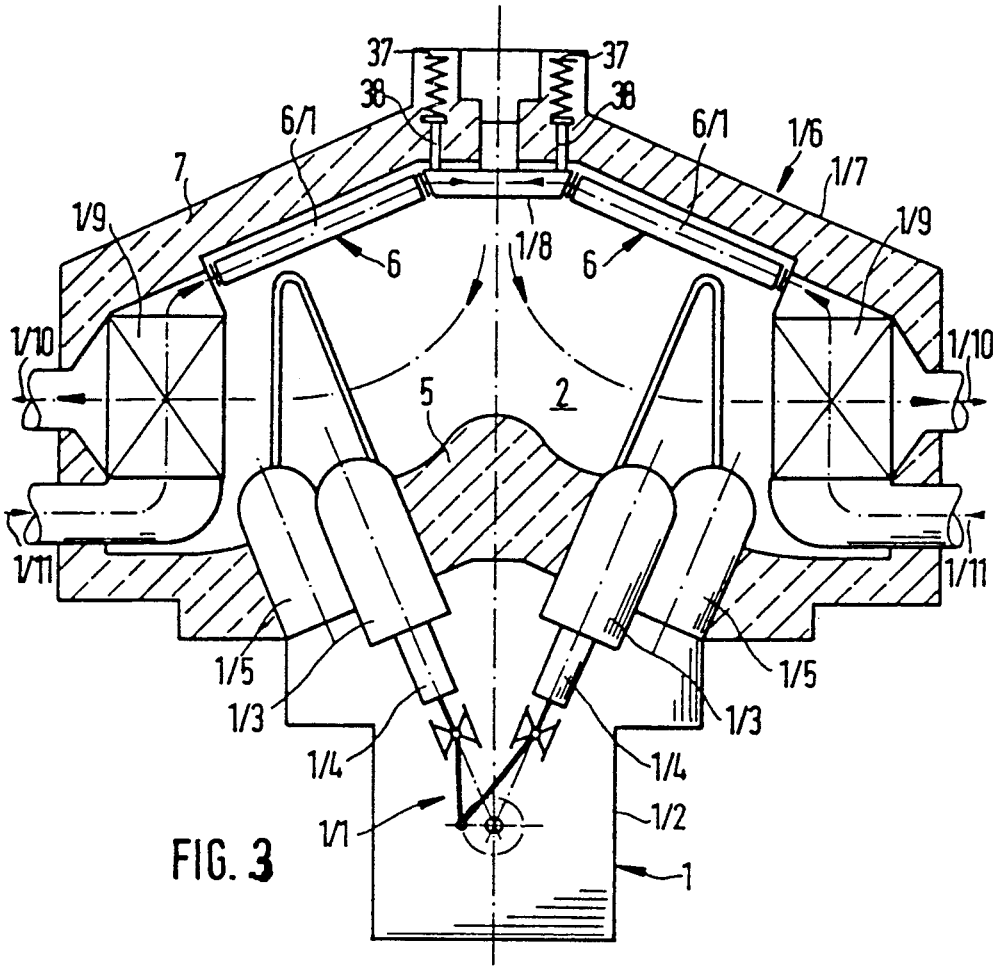
FIG. 3 is a cross section taken through a Stirling V-engine differing from that shown in FIG. 2.
Figure 4:
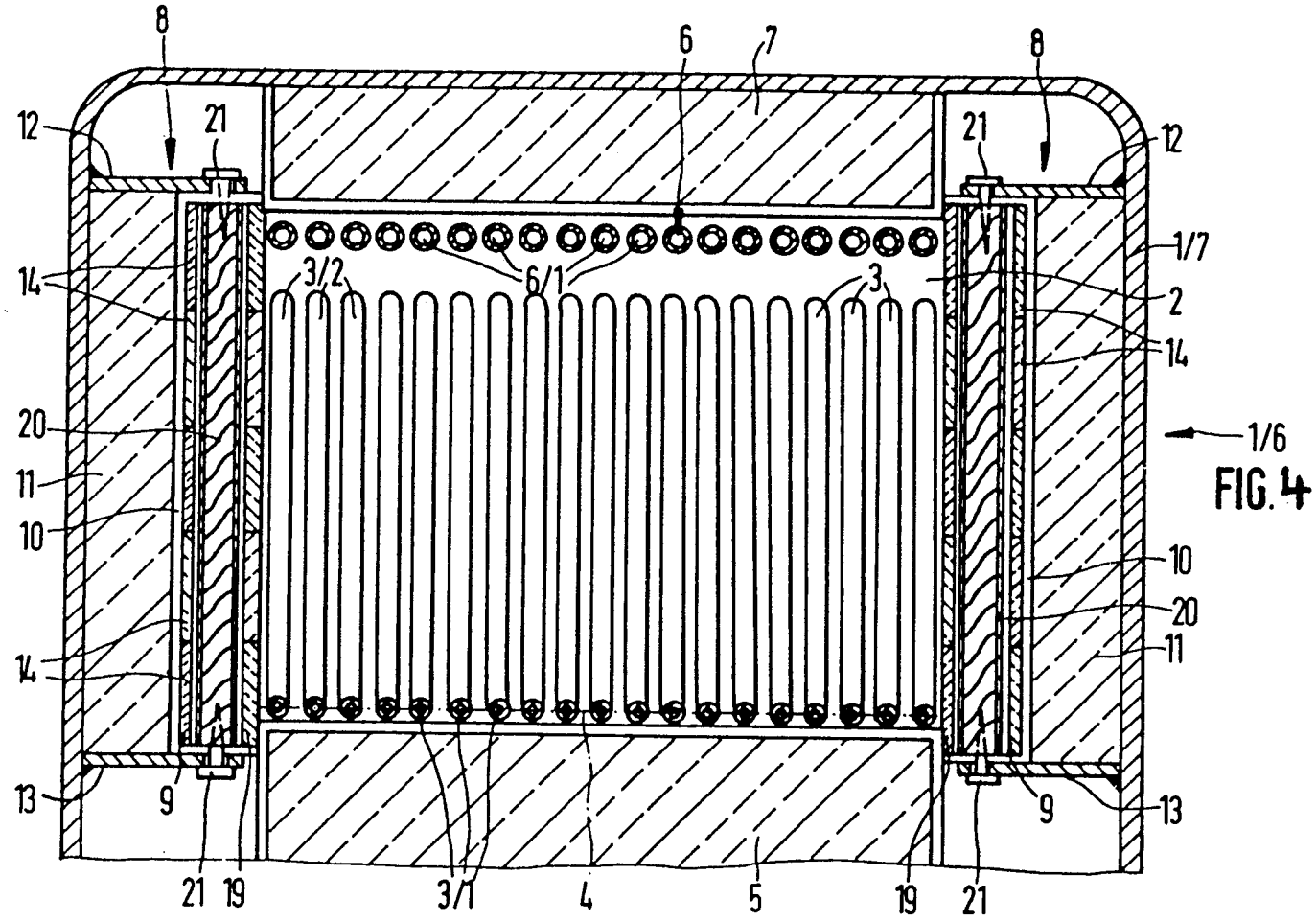
FIG. 4 is a section taken through a Stirling engine in a direction perpendicular to the direction of combustion gas flow.

The heater tubes 3 are connected in a conventional manner with manifold ducts, which are not shown, and in the design shown in FIG. 4 extend from a lower plane (marked by the broken line 4) with parallel sections 3/1 so as to extend into the heater space 2. The heater tubes 3 are bent into U-shape and form spaced parallel sections 3/2, such sections forming a heater tube wall perpendicular to the direction of the burnt gas flow. In the case of FIGS. 2 and 3, there are two such heater tube wall arrays due to the V-like arrangement of the two cylinders 1/3 and the associated cooler units 1/5.

The heater space or chamber 2 having the burnt gases flowing through it is closed on all sides to form a burnt gas duct, that is to say at the bottom by a thermally insulating layer 5, not shown in detail, at the top by a device for ducting the combustion air and on the outside and in front of the latter a thermally insulating layer 7 which is contiguous therewith or is spaced at small distance therefrom. On the right and on the left there is an insulating lining 8.

The lining 8 consists of an inner insulating wall 9 which is arranged in the housing of the heater system 1/6 so as to be spaced from the outer wall 1/7. Wall 9 is made up of adjacent replaceably secured insulating elements of ceramic material. The space between wall 9 and outer wall 1/7 is packed with ceramic fiber or lump insulating material 11, filling the intermediate space between the outer wall 1/7 and the insulating wall 9. An intermediate layer of ceramic paper 10 may be placed in the space.

The internal insulating wall 9 extends between two edge rails 12 and 13 of metal able to resist elevated temperatures and which are attached, e.g. by being welded or screwed, outside the heater space 2, through which the burnt gases flow, to the inner face of the outer wall 1/7. These rails serve both as support rails for the insulating wall 9 and also as the upper and lower limiting wall for the intermediate space charged with insulating material 11.

As seen in FIG. 4, the inner insulating wall 9 of the lining 8 is formed by a plurality of rectangular ceramic tiles or plates 14, which are formed with longitudinal grooves or ceramic tubes 19 possible with the interposition of ceramic paper ply 17 and 18. The ceramic tubes 19 extend between the two edge rails 12 and 13. They are detachably joined to rails 12, 13 at their ends. Each of the ceramic tubes 19 may be packed with continuous ceramic tow or string 20 to ensure that, in the event of one of the tubes 19 fracturing, the fragments thereof and ceramic tiles 14 adjacent thereto do not drop into the heater space 2. The attachment of the ceramic tubes 19 is by means of steel or ceramic nails 21 which pass through holes 22 in the edge rails 12 and 13, the holes exactly match the tube layers. Nails 21 extend into the space in the tubes and more particularly are driven into the packing 20. The ceramic plates or tiles 14 have a thickness of for instance 30 mm; the associated ceramic tubes 19 have an external diameter of approximately 18 mm.

Reference is made to patent application Ser. No. 07/269,639, filed Nov. 10, 1988, Erber, now U.S. Pat. No. 4,953,354 , for further details of the insulating wall. Fill 11 is 2 to 4 times the thickness of wall 9.

The arrangement in accordance with the invention, for guiding or ducting the combustion air 6 consists of a large number of refractory metal and/or ceramic tubes 6/1 (see FIG. 4) placed in at least one row so as to extend closely adjacent to each other. These tubes 6/1 form a continuous wall and at the one end are connected with the air preheater 1/9 and at the other end are connected with the burner 1/8. Air preheated to approximately 800° to 950° C. in the air preheater 1/9 is passed through these tubes 6/1 to the burner 1/8.

The tubes have circular cross section. This arrangement and design ensures satisfactory and regular flow conditions and a sufficiently even internal cooling of all the tubes 6/1. The tubes 6/1 are externally subject to burnt gas at about 2000° C. The tubes 6/1 are able to withstand a high internal pressure and do not bulge outwards owing to their, in cross section , circular shape.

The tubes 6/1 for the combustion air may be placed directly adjacent to each other or with a small clearance between them. The tube wall so produced may be arranged in the housing of the heater system 1/6 directly adjacent a wall thereof (see FIGS. 1 and 2) or with a slight intermediate clearance in front of the thermally insulating lever 7 (see FIGS. 3 and 4) so as to form an additional heat shield.

The tubes 6/1 for the combustion air consist of refractory material such as either a metallic material, as for instance a suitable steel, or of a ceramic material such as silicon carbide (SiC) or the like, or metal-ceramic material. Ceramic or metal-ceramic tubes 6/1 may also have metal end pieces.

The tubes for the combustion air 6/1 may be connected at one end with the air preheater 1/9 and at the other with the burner 1/8 by welding, bonding or brazing with refractory joining materials, see FIG. 2. They are then sufficiently stiff to form a wall of tubes which can carry the burners 1/8, for instance in a cantilever manner. This autogenously welded or bonded structure is especially suitable for tubes 6/1 subject to a relatively even thermal load, that is to say to a composite structure of tubes in which all tubes are externally subject to burnt gas which has a substantially uniform temperature profile.

Figure 5:
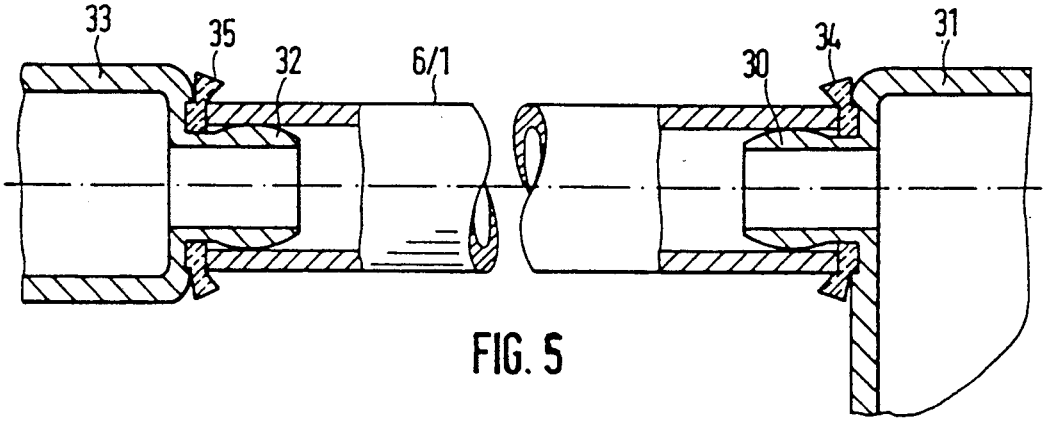
FIG. 5 shows some details of a working embodiment of the ducting system for combustion air in accordance with the invention.

In the case of combustion air duct means more intensely heated by burner flames in which complete combustion takes place in a short flame length, locally different temperatures in the heater space 2 would lead to different longitudinal thermal expansion of the tubes 6/1. As a consequence, the position of the burner 1/8 held by the tubes 6/1, which, as shown in FIG. 2, is placed centrally in the housing if the heater system 1/6 might vary excessively, that is to say the burner 1/8 might assume a skew position so that it would tend to cause an undesired local overheating of the heater system 1/6. In order to preclude this as shown in FIGS. 1 and 3, the tubes 6/1 for the air, the air preheater or preheaters 1/9 and the burner or burners 1/8 are detachably joined together in a modular manner as separate components plugged into each other and supported relative to each other. In this case the ends of the tubes 6/1 for the combustion air are, as may be seen from FIG. 5, slipped over connecting tubes 30 at the burner inlet 31, 32 and, respectively, the air preheater outlet 33. Furthermore, these connections are sealed by intermediate end seals 34 and 35 of refractory material, as for instance ceramic paper. Preferably the seals 34 and 35 form a single plate gasket serving a number of adjacent tube connections. Furthermore, as may also be seen from FIG. 5, the connecting tubes 30 and 32 are outwardly buldged. The external diameter of the collar or the buldge is matched to the internal diameter of the tubes 6/1 so that tubes 6/1 can be slipped thereover. The outwardly part-spherical collar permits angular misalignment between the center axes of the connecting tubes 30 and 32 and the tubes 6/1 without seizing and jamming. A gap present at a low temperature closes on heating to the operating temperature at least to a substantial extent. In order to make this possible the material of the connecting tubes 30 and 32 is suitably selected having regard to the material of the tubes 6/1 and the thermal expansion thereof so that the connecting tubes 30 and 32 undergo a greater expansion on heating than the tubes 6/1 and thus a gap which is precisely set during production between the connecting tubes 30 and 32 and the tube 6/1 is generally completely closed by the time the operating temperature is reached.

The air preheater or preheaters 1/9 may be indirectly yet rigidly connected with the housing 1/7 of the heater system 1/6 or the machine housing 1/2 of the engine 1.

In this case the burner or burners 1/8 can be movable in the housing. FIG. 1 shows burner 1/8 pivotally mounted about the bearing 36. FIG. 3 shows a slide arrangement in the housing for the heater system 1/6. The air preheaters 1/9, the burners 1/8, the tubes 6/1 and the seals 34 and 35 are pressed together by compression springs 37 arranged in the cooler part of the heater system 1/6 and acting via thrust members 38 that the slip joints or connections (see FIG. 5) are airtight. However, it would also be possible to have a reverse arrangement to that shown in FIGS. 1 and 3. As shown schematically in FIG. 2, the burner or burners 1/8 is firmly located in the housing 1/7 of the heater system 1/6 while the air preheater or preheaters 1/9 is/are movable in the housing 1/7 of the heater system 1/6 or, respectively, in the housing 1/2 of the machine. The compression springs 37 and thrust members 38 ensure the desired sealing effect.

The invention thus provides a means for ducting the combustion air which withstands the high thermal loads while being readily serviced.

We claim:

1. The combination of a Stirling cycle engine having a power unit (1/1) including an engine housing (1/2) and a cylinder (1/3)

with a heater system (1/6) arranged for ducting combustion air, said heater system comprising a heater system housing (1/7) coupled to said engine housing (1/2);

a thermally insulating lining (8) inside at least part of said heater system housing;

a heater (1/6) located in said heater system housing (1/7), a burner (1/8);

a combustion air preheater (1/9) through which combustion air (1/11) for said burner passes and through which, further, combustion gases (1/10) from said burner pass for preheating the combustion air; and a combustion air ducting means (6/1) connected between said preheater (1/9) and the burner (1/8), and wherein said combustion air ducting means includes a plurality of tubes or pipes (6/1) located in at least one layer adjacent each other to form a wall structure interiorily of said heater system housing.

2. The combination of claim 1, wherein the air preheater (1/9) is movably positioned in said heater system housing (1/7), said burner is securely located in said heater system housing (1/7);

and compression spring means (37) are provided located on the heater system housing at a location remote from exposure to direct heating upon operation of said burner and acting on said air preheater for pressing said air preheater, and hence said combustion air duct means towards the burner and effecting a tight connection or joint and seal said connection of joint.

3. The combination of claim 1, wherein said air preheater (1/9) is securely retained in the heater system housing (1/7);

said burner (1/8) being movably positioned within the heater system housing;

and compression spring means located on the heater system housing at a location remote from exposure to direct heat upon operation of the burner acting on said burner to compress the joints and form a tight seal of the joints.

4. The combination of claim 1, wherein the air preheater (1/9) is movably positioned in said heater system housing (1/7), said burner is securely located in said heater system housing (1/7);

and compression spring means (37) are provided located on the heater system housing at a location remote from exposure to direct heat upon operation of said burner and acting on said air preheater for pressing said air preheater, and hence said combustion air duct means towards the burner and effecting a tight connection or joint and seal said connection or joint.

5. The combination of claim 1, wherein the tubes or pipes (6/1) for the combustion air are located in adjacent contact or with only small clearance between each other to form an essentially continuous wall structure;

and wherein said essentially continuous wall structure formed of said tubes or pipes is located inside the housing and adjacent at least part of said thermally insulating lining (8) to form a heat shield, said wall being located closely adjacent to or spaced by a small distance in front of said thermally insulating lining.

6. The combination of claim 1, wherein said tubes or pipes are made of high temperature resistant refractory metal.

7. The combination of claim 1, wherein said tubes or pipes are made of ceramic material, which ceramic material optionally comprises silicon carbide.

8. The combination of claim 1, wherein said tubes or pipes are made of a metal-ceramic material.

9. The combination of claim 1, wherein said tubes or pipes are made of a high temperature resistant non-metallic material;

and metal end elements are fitted on said non-metallic tubes or pipes.

10. The combination of claim 1, wherein said tubes or pipes include metallic end portions;

and wherein said metallic end portions, are, respectively, welded to the burner (1/8) and air preheater (1/9) at the respective ends.

11. The combination of claim 1, wherein said tubes or pipes for combustion air have end portions made of non-metallic high temperature resistant material;

and bonding refractory cement is provided, connecting and sealing the ends of the tubes or pipes to, respectively, at least one of: said burner (1/8) and said air preheater (1/9).

12. The combination of claim 1, wherein said tubes or pipes for the combustion air have end portions of metallic material;

and wherein said end portions are sealingly connected to the air preheater (1/9) and to the burner (1/8) by a refractory brazing compound.

13. The combination of claim 1, wherein said tubes or pipes are separately joined in modular form and connected by a plug-receptacle interengaging interfitting connection forming a continuous fluid communication connection and a mechanical support.

14. The combination of claim 13, wherein at least one of: said burner (1/8), said air preheater (1/9) and an end portion of said tubes or pipes includes a slip joint having interfitting pipe parts; and refractory sealing material (34, 35) comprising high temperature resistant material sealing the respective slip joints.

15. The combination of claim 14, wherein said high temperature resistant material is formed in sheet or gasket form for sealing a plurality of adjacent pipes or tubes.

16. The combination of claim 14, wherein at least one of said pipe parts is formed with a part-spherical bulge or collar (30, 32) to permit angular deviation of the pipe parts from each other;

and wherein the inner diameter of the pipe part (6/1) is dimensioned with respect to the outer diameter of the part-spherical collar to leave, at non-operating temperature, a small gap, which small gap closes when, in operation of the burner, the tubes or pipes expand to, efficiently, close said gap in operation of the Stirling engine.

17. The combination of claim 16, wherein the respective materials of the end parts are selected such that the coefficient of thermal expansion of the outer one of the pipe parts is so selected with respect to the coefficient of thermal expansion of the inner one of the pipe parts that, upon heating of the joint in operation of the Stirling cycle engine, the inner one of the pipe parts expands more than the outer one so as to at least substantially close said gap when operating temperature of said Stirling engine is reached upon operation of said burner (1/8).

18. The combination of claim 14, wherein said air preheater (1/9) is securely retained in the heater system housing (1/7);

said burner (1/8) being movably positioned within the heater system housing;

and compression spring means located on the heater system housing at a location remote from exposure to direct heat upon operation of the burner acting on said burner to compress the joints and form a tight seal of the joints.

19. The combination of claim 5, wherein said air preheater (1/9) is securely retained in the heater system housing (1/7);

said burner (1/8) being movably positioned within the housing;

said compression spring means located on the heater system housing at a location remote from exposure to direct heat upon operation of the burner acting on said burner to compress the joints and form a tight seal of the joints.

20. The combination of claim 5, wherein the air preheater (1/9) is movably positioned in said heater system housing (1/7), said burner is securely located in said heater system housing (1/7);

a compression spring means (37) are provided located on the heater system housing at a location remote from exposure to direct heat upon operation of said burner and acting on said air preheater from pressing said air preheater, and hence said combustion air duct means towards the burner and effecting a tight connection or joint and seal said connection of joint.

* * * * *